United States Patent [19]

Keen et al.

[11] 3,968,856

[45] July 13, 1976

[54] SPIRAL SLIDE FIRE ESCAPE

[76] Inventors: Warren L. Keen; George Spector, both c/o George Spector, 3615 Woolworth Bldg., 233 Broadway, New York, N.Y. 10007

[22] Filed: Aug. 7, 1974

[21] Appl. No.: 495,444

[52] U.S. Cl. ..... 182/48; 193/12; 49/364

[51] Int. Cl.[2] ..... A62B 1/20

[58] Field of Search ..... 182/48, 49; 193/12; 49/364

[56] References Cited

UNITED STATES PATENTS

| | | | |
|---|---|---|---|
| 258,247 | 5/1882 | Nicholson | 182/48 |
| 287,880 | 11/1883 | Small | 182/48 |
| 670,050 | 3/1901 | Hull | 182/48 |

*Primary Examiner*—Reinaldo P. Machado

[57] ABSTRACT

A new type of building fire escape consisting of an upright tube containing a spiral slide extending throughout its length, access doors along the sides of the tube so to allow persons on each floor of a building to enter, and an exit door at a lower end of the tube; the device providing an escape that encloses the people from flames, smoke and choking gases while escaping burning building.

1 Claim, 6 Drawing Figures

SPIRAL SLIDE FIRE ESCAPE

This invention relates generally to building fire escapes.

A principal object of the present invention is to provide a fire escape that safely encloses escaping persons from flames, heat, smoke, gas and falling structure so that it is safer than an open fire escape on which escaping persons are exposed to all fire hazards.

Another object is to provide a fire escape which is particularly suitable for tall buildings having many floors, and which more quickly delivers escaping persons to a street level, than persons walking and climbing down an open fire escape.

Still another object is to provide a fire escape that is less frightening to little children and others because they cannot see the frightening distance from a great height down toward a ground.

Other objects are to provide a fire escape that is simple in design, inexpensive to manufacture, rugged in construction easy to use and efficient in operation.

These and other objects will be readily evident upon a study of the following specification and the accompanying drawing wherein.

Figure 1:
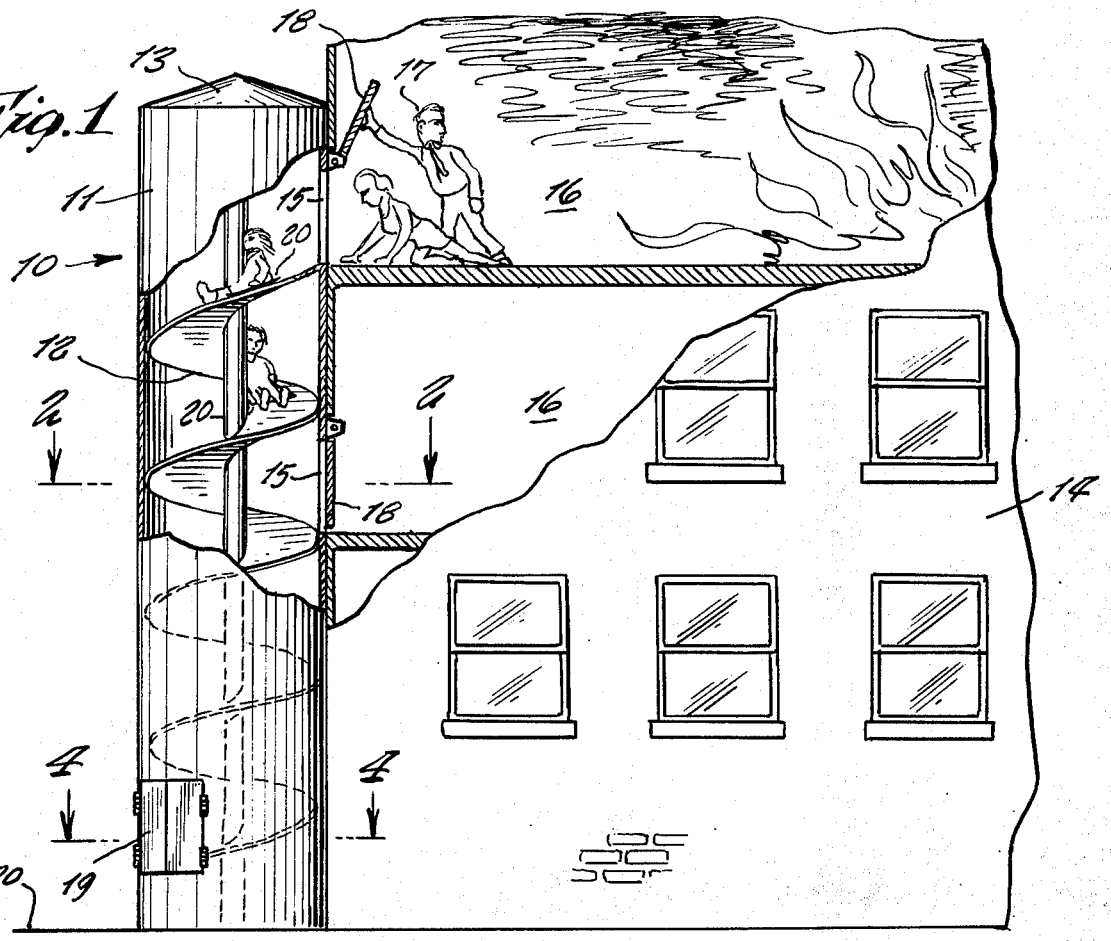
FIG. 1 is a side view partly in cross section of the present invention installed at a house that is on fire and affords escape for residents.
Figure 2:
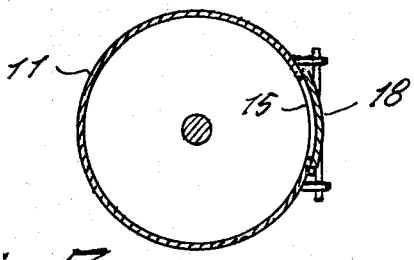
FIG. 2 is a cross section on line 2—2 of FIG. 1.

Referring now to the drawing in detail, the reference numeral 10 represents a spiral slide fire escpae according to the present invention wherein there is an upright cylindrical tube 11 that contains a spiral shaped slide 12 extending throughout its length. The upper end of the tube is covered by a fire proof roof 13 made of steel or the like. The tube and spiral are made of likewise fireproof material.

The tube can be installed either within the interior of a building 14, or else it may be permanently erected adjacent an outer side thereof as shown in FIG. 1 of the drawing. A series of access doorways 15 are provided along the side of the tube, each doorway communicating with one of the building floors 16 so that persons 17 on all floors have access thereto for escape.

Each door way is fitted with an upwardly pivotable door 18 so that it automatically closes by gravity force when a person rushes into the fire escape without thinking or consideration of the inadvisability of the doorways being left open during a fire, so that flames, suffocating gas and burning debris do not enter. Each doorway 15 is low near a floor so a person can find it easier if clouds of smoke fill the upper air layers.

The fire escape diameter may be about six foot diameter, or even larger if heavier traffic is possible such as in very tall buildings. It would be made in section lengths secured together.

An exit doorway 19 at a street level would permit escaped persons to leave the fire escape.

Electric lights for illuminating the fire escape interior may be provided to automatically turn on when a person enters the fire escape.

In use, escaping persons would sit on a mat 20 made of a suitable material for comfort and slide on it down the spiral slide or chute, as shown in FIG. 1.

The doorway 19 could be normally locked from inside so to prevent unauthorized persons from a street to enter and thus enter the building. However, during an escape from a burning building, a first person or child reaching the door 19 automatically opens the door by bumping against a mechanism 22.

Figure 4:
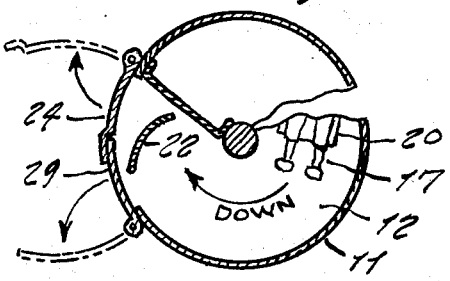
FIG. 4 is a cross section on line 4—4 of FIG. 1, and together with FIGS. 5 and 6 show a mechanism that automatically opens up the lower exit door when a first person's feet strike against it, so that even a child going first will open the door without any knowledge or physical strength.
Figure 3:
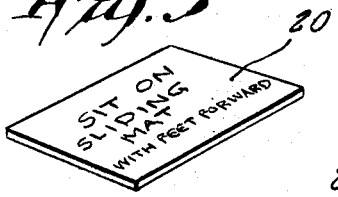
FIG. 3 is a sliding mat for use by persons.
Figure 5:
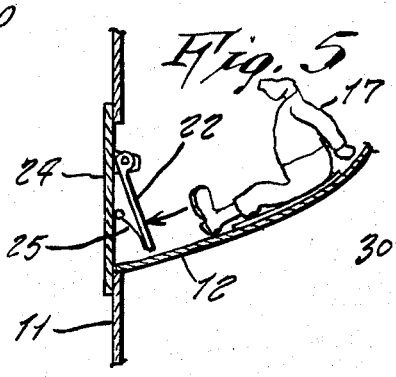
FIG. 5 being a side cross section, and FIG. 6 showing the mechanism on the doors.
Figure 6:
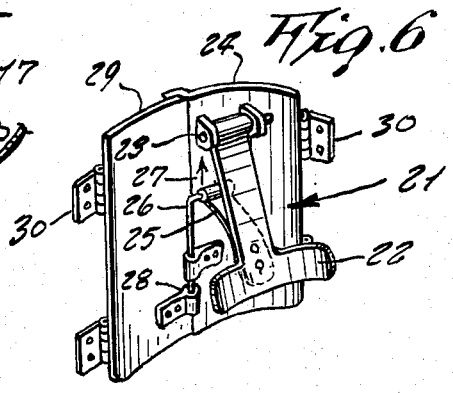

The mechanism 22, shown in FIG. 4 through 6, includes lever 22 (for being struck by a person), the lever being pivotable on pin 23 supported on one door 24. A leaf spring 25 secured at one end to the lever is pivotally attached at its other end to a bar 26 so that the bar is pushed up as shown by arrow 27 when the lever is pushed. The lifting bar thus slips out of latch 28, thus allowing both doors 24 and 29 to swing open outward on hinges 30.

Thus an improved spiral slide fire escape is provided.

While various changes may be made in the detail construction, it is understood that such changes will be within the spirit and scope of the present invention as is defined by the appended claims.

What is claimed is:

1. A spiral fire escape, comprising a vertical tube containing a spiral slide, said tube being mounted adjacent a vertical wall forming the sides of vertically aligned rooms, including an access door from each room and a corresponding adjacent aligned doorway formed through said tube, wherein corresponding aligned doors and doorways are of equal vertical dimension and are disposed between spaced adjacent portions of said slide providing unobstructed access into said slide, in further combination with a hinged exit door at the slide bottom, said door including a latch mounted slidably on the inside of said door, said latch being slidable from a normally locked position to an open position by means resiliently retaining the latch in the locked position in combination with a lever pivotally mounted on said door engaging said means, said lever being normally in a position corresponding to the locked position of said latch and movable to position causing said means to move the latch to said open position upon impact of a person descending from said slide wherein the exit door comprises adjacent similar portions pivotable about vertical axis having opposing brackets with vertically aligned holes, said latch having a rod normally extending through said holes and an upper end in engagement with said means, wherein said lever is pivotally mounted about a horizontal pin on said door and includes a lower impact bumper facing the escaping person, said means comprising a leaf spring engaging the bumper at one end and the upper end of said rod at the opposite end of the spring.

* * * * *